United States Patent [19]

Keller

[11] Patent Number: 5,072,862

[45] Date of Patent: Dec. 17, 1991

[54] FLOW MIXER

[76] Inventor: Wilhelm A. Keller, Riedstrasse 1, CH-6330 Cham, Switzerland

[21] Appl. No.: 512,068

[22] Filed: Apr. 16, 1990

Related U.S. Application Data

[63] Continuation of Ser. No. 189,549, May 3, 1988, abandoned.

[30] Foreign Application Priority Data

May 6, 1987 [CH] Switzerland ..... 01729/87

[51] Int. Cl.[5] ..... B65D 5/72

[52] U.S. Cl. ..... 222/496; 222/327; 222/518

[58] Field of Search ..... 222/327, 386, 387, 389, 222/496, 495, 497, 571, 402.12, 518

[56] References Cited

U.S. PATENT DOCUMENTS

| | | | |
|---|---|---|---|
| 2,080,427 | 5/1937 | McLaughlin | 222/496 |
| 2,758,758 | 8/1956 | Schimpf | 222/327 |
| 4,366,919 | 1/1983 | Anderson | 222/327 |
| 4,634,027 | 11/1987 | Kanarvogel | 222/496 |

FOREIGN PATENT DOCUMENTS

| | | | |
|---|---|---|---|
| 0084741 | 5/1983 | Japan | 222/496 |
| 726756 | 3/1955 | United Kingdom | 222/496 |

*Primary Examiner*—D. Glenn Dayoan
*Assistant Examiner*—Kenneth Noland
*Attorney, Agent, or Firm*—Darby & Darby

[57] ABSTRACT

In a flow mixer for liquid or pasty media, the flow of the mixture is to be interrupted instantly at the end of the usually intermittent discharge of material to prevent continued flow or drooling. To this end, a check valve with predetermined opening pressure is provided, arranged in series with the mixing elements. The valve may be realized in various structural types, e.g. as diaphragm valve and may be arranged either continguous to the mixing elements in the orifice region or preceding the latter in the entrance region of the mixer. The mixer may alternatively contain only one valve part, namely a resiliently movable valve body, which cooperates with the orifice region of a connected double-discharge cartridge.

6 Claims, 2 Drawing Sheets

FLOW MIXER

"This is a continuation of application Ser. No. 189,549, filed May 3, 1988 now abandoned.

FIELD OF THE INVENTION

The invention relates to a flow mixer for liquid or pasty media, with mixing elements strung together lengthwise in a mixer tube.

BACKGROUND OF THE PRIOR ART

Such flow mixers (also called "static mixers" because of the mixing elements held stationary in the tube) are often used for mixing and homogenizing substances which must be stored separately in two components but must be mixed for processing, as, for example, adhesives, sealants, paints, dental impression materials, etc. As a rule, cheap disposable mixers for a single use are involved, which are exchangeably attached to supply cartridges for the two material components (e.g. according to EP-A 0121342). Flow mixers of this kind are often used intermittently, i.e., with batchwise throughput of composition. This results in the disadvantage that the mixture tends to continue to flow or drip out of the tip of the mixer tube at the end of a "shove", this being the case especially with relatively thin media. This continued flow is, of course, a hindrance to neat working and makes exactly proportioned discharge of specific partial amounts of the mixed material impossible.

Such flow mixers can be used to advantage together with cartridges which according to an as yet unpublished proposal of the same applicant are equipped with specially designed feed pistons which can recede a little when the piston ceases to advance (Swiss Patent Application No. 00 555/87-0=EP Application No. 88101393.2, U.S. Pat. No. 4,834,268); in this connection another proposal should be mentioned (EP Application No. 0 252 401 of the same applicant; U.S. Pat. No. 4,826,053, according to which a discharge device for the operation of said cartridges is designed so that its ram driving the feed pistons forward is automatically retracted from the feed pistons immediately after each forward movement has been stopped. In any case, however, it is important that an increased internal pressure in the cartridges, as it exists during the discharge of the components, will diminish immediately and be released only towards the rear of the cartridges, i.e. toward the feed pistons or rams.

SUMMARY OF THE INVENTION

It is an object of the invention to instantly stop the flow of the mixture at the end of a discharge of material in a flow mixer of the mentioned kind and thus to prevent afterflow (drooling), while supporting measures of the above-mentioned kind at the cartridge feed pistons and/or at the discharge device by creation of a "backpressure" from the mixer. According to the invention, this problem is solved in that the mixer contains at least parts of a check valve, disposed in series with the mixing elements, with a valve body directly acted upon by the material to be mixed and with a predetermined opening pressure.

It is achieved thereby that the check valve closes and interrupts the flow of material as soon as the feed pressure prevailing during discharge abates. In its present application, therefore, the check valve has only a closing function and not the task to prevent return flow of the mixture which already has passed the check valve. The valve opening pressure to be overcome is practically immaterial in view of the relatively high discharge pressure required. Furthermore, the opening pressure of the valve produces the desired reaction toward the pistons of the cartridge, and this also occurs in the case of relatively low viscosity media whose flow resistance in the mixer is low. It may be desirable to arrange the check valve at the mixer entrance—instead of at the end of the mixer tube.

It should be mentioned also that for several devices such as spray nozzles, taps at gasoline filling stations (pumps), outflow controls, etc., valves at the discharge nozzle are known for preventing continued dripping of liquid. In such cases, however, cooperation of a valve with a mixer or with cartridges and their contents is not involved, and a backpressure caused by the valve is even then undesirable.

Several embodiments of the flow mixer according to the invention are described more specifically below in conjunction with the drawing. The scope of the invention will be pointed out in the appended claims.

BRIEF DESCRIPTION OF THE DRAWINGS

In the drawings, the individual figures are longitudinal sections through parts of the flow mixer with valve, namely.

DESCRIPTION OF THE PREFERRED EMBODIMENTS

All illustrated flow mixers 1 are of the so-called disposable mixer type made from plastic material as used in connection with double cartridges. In a known manner, in a mixer tube 2, a number of mixing elements are arranged lengthwise and held immobile, here in the form of mixing elements 3, shown only schematically, with alternating right-hand and left-hand twist and with each element rotated by 90° with respect to the adjacent element.

Figure 1:
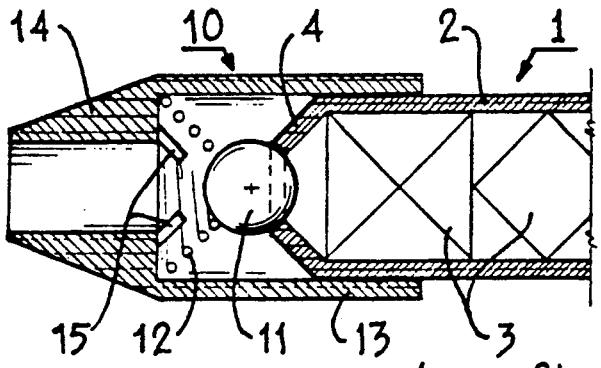
FIG. 1—showing the orifice region of a mixer with ball valve.

In the embodiment of a mixer according to FIG. 1, a check valve in the form of a ball valve 10 is disposed in the orifice region of mixer 1, i.e. contiguous to the mixing elements 3. A tubular valve housing 13 is fastened to the front end of the mixer tube 2, preferably undetachably, for instance by gluing, welding, or threading. The conically converging orifice 4 of the mixer tube serves as a valve seat for the spherical valve body 11. The latter is under the action of a pre-tensioned valve spring 12, which braces itself against a collar surface on the interior of the housing 13. The valve housing is provided with an orifice 14 designed as a discharge nozzle.

The check valve 10 axially connecting with the mixer tube 2, as shown, is normally closed, and this with an opening pressure which is determined by the initial tension of the valve spring 12. Therefore, the material mixture present inside the mixer tube 2 cannot flow out or drip unintentionally. When discharge of material is to start, the material in the mixer is set under pressure from the mixer entrance (at right in FIG. 1). This pressure overcomes the mentioned opening pressure of valve 10 or, respectively, the valve spring 12 by direct action on the valve ball 11 by the material to be mixed, so that the ball shifts to the left and the mixture can issue past it through the nozzle 14. The movement of the valve ball 11 is limited by stop pins 15 integrally formed on the nozzle 14. When the discharge pressure diminishes, ball 11 moves back to the closing position by means of the valve spring 12 and the flow of material is stopped instantly, and the existing pressure, which acts rearwardly against the piston of the cartridge (not shown), is being reduced. The check valve 10 could alternatively be designed as a conical valve with a valve cone instead of the ball 11.

Figure 2:
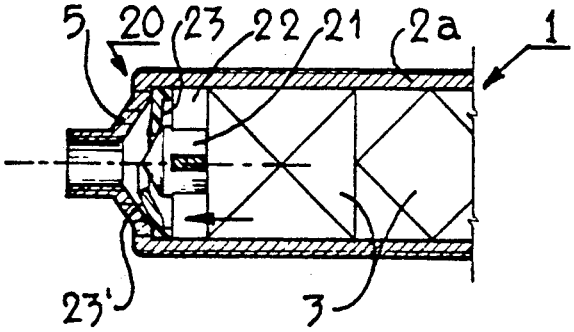
FIG. 2—the orifice region of another mixer with installed diaphragm valve.

In the embodiment according to FIG. 2, the check valve 20 is likewise disposed in the orifice region of mixer 1 contiguous to the mixing elements 3, but is installed inside the mixer tube 2*a*. The check valve 20 is designed as a diaphragm valve, the upper half of the figure showing the valve closed and the lower half open, as during discharge of material in the arrow direction. Between the last mixing element 3 and the discharge nozzle 5 of the mixer tube is an axially arranged, conically tapered flow body 21, which is centered and retained in the mixer tube by four projecting spokes 22. Alternatively, the body 21 could be integrally formed on the exit end of the last mixing element 3. Ahead of the body 21 is, as valve body, a diaphragm 23 of rubber-elastic material with a central passage opening which is a little smaller than the diameter of body 21.

With the diaphragm valve normally closed (upper half in FIG. 2), the diaphragm 23 presses with its aperture edge against body 21 under elastic initial tension. Owing to this, there exists in turn a predetermined opening pressure, which prevents material present in mixer 1 from releasing. Upon discharge of material this opening pressure is overcome, diaphragm 23 is lifted off the body and deformed into its position 23' (lower half in FIG. 2), and the mixture of material can release through nozzle 5. Here, too, the elastic initial tension of the valve diaphragm brings about immediate closing of the valve as the discharge pressure abates by acting rearwardly against the pistons of the cartridges.

Figure 3:
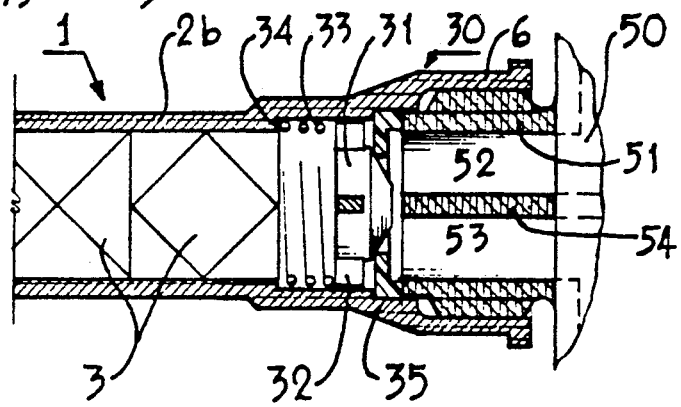
FIG. 3—the entrance region with conical valve of yet another mixer connected to the mouth of a double cartridge.

The following two embodiments relate to flow mixers 1 in which a check valve is disposed in the entrance region, that is, preceding the mixing elements 3. In the form according to FIG. 3, the stub 6 of the mixing tube 2*b* is screwed to the orifice 51 of a double cartridge 50, which orifice has two discharge passages 52, 53 for the two substance components to be mixed. The check valve 30 is a conical valve with fixed valve seat disk 35 and movable valve cone 31. The latter is guided for axial movement in the mixer tube by four guide lobes 32 and is held against the valve opening in disk 35 by the pre-tensioned valve spring 33, which braces itself against a collar surface 34. The mechanism of action of check valve 30 is practically the same as in the preceding examples, except that the material is already prevented from passing from cartridge 50 into the mixer 1. Above all, with the valve closed, any "creeping" flow in the orifice region of the cartridge is suppressed.

Figure 4:
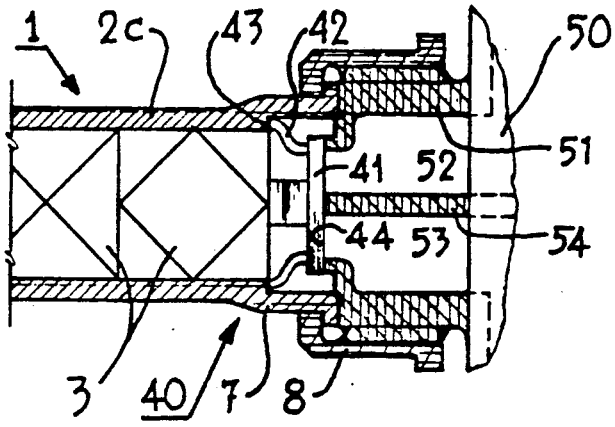
FIG. 4—The entrance region of a mixer, also connected to the orifice of a double cartridge, a valve disk being installed which is intended to cooperate with the cartridge orifice.

In the variation according to FIG. 4, the entrance stub 7 of the mixer tube 2*c* is screwed to the orifice 51 of a double cartridge 50 by means of a retaining nut 8. A disk valve is provided as check valve 40 in the entrance region of the mixer. Here, however, only a part of valve 40, namely the movable valve disk 41, is part of the mixer 1, while the valve is completed by the plane end face of the cartridge orifice 51 with which the seat surface 44 of the valve disk cooperates. On its back side, seat surface 44 of the valve disk cooperates. On its back side, the valve disk 41 has integrally formed curved spring lobes 42, which take support on the collar surface 43 on the inside of the mixer tube. Thereby the valve disk is held under prestress against the end surface of orifice 51, owing to which the valve remains normally closed. It is only with increasing discharge pressure of the substance components from cartridge 50 that the valve disk 41 recedes (to the left in FIG. 4), and both discharge passages 52 and 53 are released simultaneously for substance transfer into mixer 1. Also the closing of both passages at the end of a partial discharge again occurs simultaneously through the valve disk.

The valve according to FIG. 4 may prevent a (very undesired) return flow of mixture into the cartridge, as could occur for instance due to volume reduction upon cooling of the cartridge contents during intervals discharges. Furthermore, the valve arrangement at the mixer entrance prevents not only the undesired "continued flow" but also premature outflow of material from the cartridge when the still empty mixer is attached, particularly with low viscosity materials.

A special advantage of the embodiment according to FIG. 4 further consists in that by virtue of the movable valve organ 41, also the connection between the passages 52 and 53 remains interrupted during the intervals between discharges (valve closed). Thereby the two components are prevented from undesired mutual contact at the interface between mixer and cartridge during intervals between discharges or respectively before entrance into the mixer.

Figure 5:
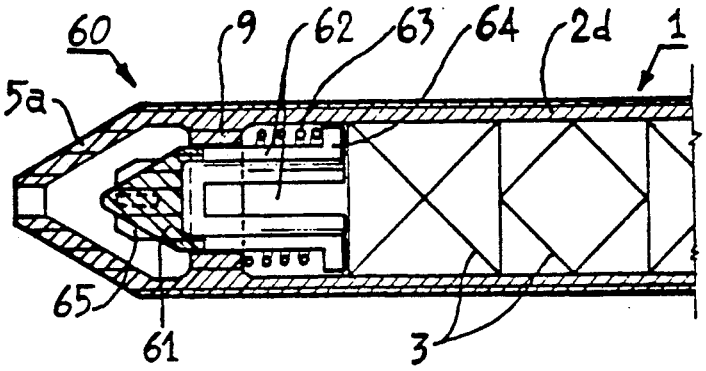
FIG. 5—another mixer with slide valve installed in the orifice region.

In the embodiment according to FIG. 5, the check valve 60 is designed as a slide valve and is installed in the orifice region of mixer 1, i.e. between the last mixing element 3 and the discharge nozzle 5*a* in the mixer 2*d*. As valve body, a cylindrical valve slide 61 with longitudinal slots 62 is axially displaceable in a guide 9 of the mixer tube. Between a collar 64 of slide 61 and the guide 9, there is a compression spring 63 which, in the absence of discharge pressure, holds valve 60 in the closed position shown. Upon discharge of material, by pressure of the material to be mixed on the valve body 61, the spring force is overcome and the slide 61 is pushed forward until the slots 62 have passed guide 9 whereupon the mixture can leave via the slots 62 and enter the chamber located behind the discharge orifice of the mixing tube. After termination of the discharge stroke, spring 63 brings slide 61 immediately back into the closed position and discharge of material is blocked. Being that the head of the valve slide 61 (provided with stop ribs 65 is designed, as illustrated, "torpedo-like", matching the inner form of nozzle 5*a*, the volume between slide and nozzle orifice is kept small, and as slide 61 moves back, it exerts a slight suction, which again helps to prevent drooling of the material.

The structural types of check valves described (as well as additional ones) may in principle be arranged also at the respective other mixer end from that shown in the embodiments. The respective suitable valve type and arrangement depend on the media to be discharged and on the special purpose of use. Generally, it may be said that the valve arrangement following the mixing elements is indicated rather for low viscosities of the material mixture; the arrangement at the transition from the cartridge to the mixer is suggested for use with higher or greatly different viscosities of the two components.

While the foregoing description and drawings represent the preferred embodiments of the present invention, it will be obvious to those skilled in the art that various changes and modifications may be made therein without departing from the true spirit and scope of the present invention.

What is claimed is:

1. In a flow mixer for attachment to a dispensing cartridge for liquid or pasty media, said mixer being of the type having mixing elements strung together lengthwise in a mixer tube, the improvement comprising that the mixer contains at least parts of a check valve arranged in series with the mixing elements, said value including a valve body acted upon directly by the material to be mixed and having a predetermined opening pressure, the mixer has an outlet orifice and said check valve parts are arranged at the outlet orifice of the mixer contiguous to the mixing elements, said valve body being tapered and having slots for flow therethrough toward said outlet orifice of said material to be mixed, said mixer including a guide on its inner surface, said guide having means downstream of said slots for engaging said valve body and blocking flow of said material toward the outlet orifice in a first position of said valve body, and in a second position of said valve body permitting flow of said material through said slots to said outlet orifice, application of said predetermined pressure to said material causing said valve body to move from said first position to said second position, said check valve including biasing means operating to instantly move said slide body from said second to said first position to stop the flow of the mixed material from said mixer when the expelling force applied to said dispensing cartridge ceases.

2. A flow mixer according to claim 1, wherein the check valve is installed in the interior of the mixer tube.

3. A flow mixer according to claim 1, wherein the check valve is arranged axially contiguous to and outside of the mixer tube.

4. A flow mixer according to claim 1, wherein said valve body is tapered toward said orifice and matches the inner contours of the mixer nozzle.

5. A flow mixer according to claim 1, wherein the check valve is designed as a slide valve.

6. A flow mixer according to claim 5, wherein the valve slide is shaped to match the inner form of the mixer nozzle.

* * * * *

UNITED STATES PATENT AND TRADEMARK OFFICE

CERTIFICATE OF CORRECTION

PATENT NO. : 5,072,862

DATED : December 17, 1991

INVENTOR(S) : Wilhelm A. Keller

It is certified that error appears in the above-identified patent and that said Letters Patent is hereby corrected as shown below:

On the Title page, item [76], Inventor's address should read

-- Grundstrasse 12
CH-6343 Rotkreuz
SWITZERLAND --.

Signed and Sealed this

Sixth Day of April, 1993

*Attest:*

STEPHEN G. KUNIN

*Attesting Officer*

*Acting Commissioner of Patents and Trademarks*